US005744272A

United States Patent [19]

Elsaesser et al.

[11] Patent Number: 5,744,272

[45] Date of Patent: Apr. 28, 1998

[54] ELECTROPHOTOGRAPHIC RECORDING MATERIAL FOR THE PRODUCTION OF PRINTING PLATES

[75] Inventors: Andreas Elsaesser, Idstein; Werner Frass, Wiesbaden; Fritz-Feo Grabley, Koenigstein; Gábor Jerling, Wiesbaden, all of Germany

[73] Assignee: AGFA-Gevaert AG, Leverkusen, Germany

[21] Appl. No.: 620,951

[22] Filed: Mar. 25, 1996

[30] Foreign Application Priority Data

Mar. 23, 1995 [DE] Germany ..... 195 10 526.5

[51] Int. Cl.[6] ..... G03G 5/05

[52] U.S. Cl. ..... 430/96; 430/49

[58] Field of Search ..... 430/49, 96, 31

[56] References Cited

U.S. PATENT DOCUMENTS

| | | | |
|---|---|---|---|
| 3,189,447 | 6/1965 | Neugebauer et al. | 96/1 |
| 3,257,203 | 6/1966 | Sues et al. | 96/1.5 |
| 4,461,818 | 7/1984 | Suzuki et al. | 430/49 |
| 4,477,547 | 10/1984 | Yamada et al. | 430/14 |
| 4,492,747 | 1/1985 | Brechlin | 430/96 |
| 4,528,256 | 7/1985 | Lind | 430/83 |
| 4,548,885 | 10/1985 | Brechlin | 430/49 |
| 4,654,283 | 3/1987 | Doessel et al. | 430/133 |
| 4,684,594 | 8/1987 | Schmitt et al. | 430/49 |
| 4,710,446 | 12/1987 | Hoffmann et al. | 430/910 |
| 5,035,968 | 7/1991 | Horie et al. | 430/96 |

FOREIGN PATENT DOCUMENTS

| | | |
|---|---|---|
| 65221/80 | 6/1981 | Australia . |
| 2 262 088 | 7/1973 | Germany . |
| 1357 707 | 12/1972 | United Kingdom . |

*Primary Examiner*—Christopher D. Rodee
*Attorney, Agent, or Firm*—Foley & Lardner

[57] ABSTRACT

An electrophotographic recording material comprising:

an electrically conductive base layer;

a photoconductive layer which can be de-coated with alkaline solutions, the photoconductive layer comprising an organic photoconductor, a sensitizer and a binder comprising a mixture of:

a) a copolymer comprising units composed of a first vinyl aromatic compound and units composed of maleic anhydride and/or a maleic partial ester, and b) a copolymer comprising units composed of a second vinyl aromatic compound and units of (meth)acrylic acid.

19 Claims, No Drawings

ELECTROPHOTOGRAPHIC RECORDING MATERIAL FOR THE PRODUCTION OF PRINTING PLATES

BACKGROUND OF THE INVENTION

1. Field of the Invention

The invention relates to an electrophotographic recording material for the production of printing plates, and in particular, to planographic printing plates which have an electrically conductive layer base and a photoconductive layer which contains an organic photoconductor, a sensitizer and a binder which can be stripped with aqueous alkaline solutions.

2. Description of Related Art

Recording materials of the type mentioned are generally known. The layer bases used are, for example, aluminum sheets which are grained, anodized, and optionally, hydrophilized. The photoconductive layers may comprise, for example, heterocyclic compounds such as oxazoles or oxadiazoles as organic photoconductors. As sensitizers, dyes of the triarylmethane or polymethine type may be employed. Such materials are described, for example, in U.S. Pat. Nos. 3,189,447, 3,257,203, DE-A 29 49 826 and EP-A 0 125 481.

The binders in the photoconductive layers primarily determine the strippability. Accordingly, polymers and polycondensates containing side groups which ensure aqueous alkaline strippability are generally used. Such groups are, for example, phosphonic, sulfonic and carboxylic acids or phosphonic, sulfonic and carboxylic anhydrides, sulfonamides and sulfonimides, and also phenolic hydroxyl groups.

In addition, the binders of the photoconductive layers also affect to some extent, the properties of the recording material and/or printing plates prepared therewith. Inter alia, these properties are relevant, to the processing characteristics of the recording material. For example, the use of a particular binder may affect the charging behavior, dark discharge, photosensitivity, reproduction quality, stability of the de-coating behavior, and the length and volume of the print run. High-molecular-weight styrene/maleic anhydride copolymers, which may also be partially esterified with short-chain alkanols, have proven particularly suitable as binders for photoconductive layers.

For economic and ecological reasons, it is desirable to keep the consumption of the de-coating composition below 100 ml per $m^2$ of the recording material. However, maintaining de-coater consumption values below 100 ml/$m^2$ may present problems when using the above-mentioned styrene/maleic anhydride binders. For example, when de-coater consumption values are below 100 ml/$m^2$, an increase in the proportion of the binder in the stripper results, which in turn leads to an increase in viscosity of the stripper to a considerable extent. In addition, when employing the above-mentioned binders at de-coater consumptions below 100 ml/$m^2$, the brushes and rollers of the de-coating apparatus tend to become coated, resulting in an impairment of the de-coating action. This may lead to residual haze remaining on the surface of the base layer. Accordingly, de-coater consumptions below 100 ml/$m^2$ have been difficult to achieve in practice.

SUMMARY OF THE INVENTION

An object of the invention was therefore to provide a radiation-sensitive recording material which meets the requirements for a radiation-sensitive recording material and also exhibits a better de-coating behavior, so that a higher productivity of the stripper can be achieved. In accordance with these objectives, there has been provided, an electrophotographic recording material comprising:

an electrically conductive base layer;

a photoconductive layer which can be de-coated with alkaline solutions, said photoconductive layer comprising an organic photoconductor, a sensitizer and a binder comprising a mixture of:

a) a copolymer comprising units composed of a first vinyl aromatic compound and units composed of maleic anhydride and/or a maleic partial ester, and b) a copolymer comprising units composed of a second vinyl aromatic compound and units of (meth)acrylic acid.

Additional objects, features and advantages of the invention will be set forth in the description which follows, and in part will be obvious from the description, or may be learned by practice of the invention.

DETAILED DESCRIPTION OF THE PREFERRED EMBODIMENTS

The invention proceeds from a radiation-sensitive recording material comprising an electrically conductive base layer and a photoconductive layer which can be de-coated with alkaline solutions. Alkaline de-coating compositions include aqueous solutions comprising one or more alkaline agents, such as phosphates, borates, silicates, hydroxides, carbonates or water-soluble amines. Preferred water-soluble amines are ethanolamine, propanolamine and di- and triethanolamine.

In addition, the decoating compositions preferably comprise an anionic or non-ionic surfactant. Water softeners, antifoams and other customary auxiliaries are optional.

The photoconductive layer comprises an organic photoconductor, a sensitizer and a binder comprising a mixture of a) a copolymer comprising units composed of a first vinyl aromatic compound and units composed of maleic anhydride and/or a maleic partial ester, and b) a copolymer comprising units composed of a second vinyl aromatic compound and units of (meth)acrylic acid.

In this connection, the term "(meth)acrylic acid" stands for acrylic acid and/or methacrylic acid.

Preferably, both copolymers have acid numbers between 100 and 300, most preferably between 150 and 250. Optionally, the copolymer (a) may be partially esterified with ($C_1$–$C_6$)alkanols. The content of vinyl aromatics in each copolymer (a) and (b) is preferably at least 30 mol %. In the copolymer (b), the content of vinylaromatics most preferably is at least 50 mol %.

The vinyl aromatic components in copolymers (a) and (b) may be the same or different. Suitable as vinyl aromatics are, for example, mononuclear, binuclear or trinuclear (most particularly, mononuclear) aromatic compounds which, in addition to the vinyl group, may also carry other substituents. These substituents include, for example, alkyl, aryl, alkoxy or aryloxy groups, or halogen atoms, or a-substituted vinyl aromatics. Preferred are mononuclear vinyl aromatics, that is, styrene and substituted styrenes. Examples of styrene and substituted styrenes include vinyltoluene, vinylxylene, p-chlorostyrene, vinylanisole, α-methylstyrene and α-chlorostyrene.

In addition to the vinyl aromatic units and the (meth) acrylic acid units, the copolymer (b) may also optionally contain units of (meth)acrylates, in particular ($C_1$–$C_8$)alkyl (meth)acrylates. The (meth)acrylate units, if employed, may be present in a proportion of up to 50% by weight.

The copolymer (a) preferably has a molar mass $M_W$ in the range from 20,000 to 300,000, most preferably 50,000 to 300,000. The copolymer (b) preferably has a molar mass $M_W$ in the range from 1000 to 50,000, most preferably 2000 to 30,000.

The mixing ratio of the weight of copolymer (a) to the weight of copolymer (b) is preferably between 20:1 and 1:2. The proportion of binder is preferably 20 to 80% by weight, based on the total weight of the nonvolatile constituents of the photoconductive layer.

Although the basic suitability of these two copolymers (a) and (b) for electrophotographic recording materials used individually was generally known, it was surprising that, using the above-mentioned mixture of the two copolymers, printing plates are obtained which meet the requirement for improved de-coating behavior in an excellent manner without impairment of the other relevant properties.

Primarily suitable as organic photoconductors are, for example, compounds which are based on aromatic heterocycles and which are substituted by one or more aromatic radical(s) and contain basic amino groups. Such photoconductors are described, for example, in U.S. Pat. Nos. 3,189,447, 3,257,203, DE-A 29 49 826 and EP-A 0 125 481. The above organic photoconductors based on aromatic heterocycles are most preferably derived from oxadiazole or oxazole. In addition, triphenylamine derivatives, triphenylmethane derivatives, more highly condensed aromatic hydrocarbons such as anthracene, benzo-condensed heterocycles, pyrazoline derivatives, hydrazone derivatives, imidazole derivatives or triazole derivatives may be employed as organic photoconductors. The photoconductors may be used individually or as mixtures. The proportion of organic photoconductor is preferably 20 to 80% by weight, based on the total weight of the nonvolatile constituents of the photoconductive layer.

It is generally known to use a very wide variety of dyes as sensitizers to extend the spectral sensitivity range. The following representative dyes which may be used individually or as mixtures, are particularly suitable (the numbering in brackets relates either to the Color Index or to the Schultz Dye Tables, 7th edition, volume 1, 1931):

Triarylmethane dyes: Brilliant green (No. 760; Basic Green 1; C.I. 42040), Victoria blue B (No. 822; Basic Blue 26, C.I. 44045), methylviolet 2B (No. 783; Basic Violet 1; C.I. 42535), crystal violet (No. 785; Basic Violet 3; C.I. 42555), acid violet 6B (No. 831);

Xanthene dyes: Rhodamines [rhodamine B (No. 864), rhodamine 6G (No. 866; Basic Red 1; C.I. 45160), rhodamine G extra (No. 865), sulforhodamine B (No. 863; Acid Red 52; C.I. 45100)], fast acid eosin (No. 870), phthaleins (eosin S (No. 883), eosin A (No. 881), erythrosin B (No. 886; Acid Red 51; C.I. 45430)], phloxin B (No. 890; Acid Red 92; C.I. 45410), Bengal pink (No. 889; Acid Red 94; C.I. 45440) and fluorescein (No. 880; C.I. 45350);

Thiazine dyes: such as methylene blue (No. 1038; Basic Blue 9; C.I. 52015);

Acridine dyes: Acridine yellow (No. 901; C.I. 46025), acridine orange (No. 908; C.I. 46005) and trypaflavin (No. 906);

Quinoline dyes: Pinacyanol (No. 924) and kryptocyanine (No. 927);

Quinone and ketone dyes: Alizarin (No. 1141; C.I. 58000), alizarin red S (No. 1145; Mordant Red 3; C.I. 58005) and quinizarin (No. 1148);

Cyanine dyes: Astrazone yellow 3G (Basic Yellow 11; C.I. 48055), astrazone yellow 5G (C.I. 48065), astrazone yellow 7GLL (Basic Yellow 21, C.I. 48060), astrazone yellow GRL (Basic Yellow 29), ®Astra yellow (Basic Yellow 44) and astrazone orange 3R (Basic Orange 27). Astrazone orange R (C.I. 48040) and astrazone orange G (C.I. 48035) have proved to be very particularly suitable.

The dyes are preferably used in the weight ratio of 0.001 to 0.1 parts by weight dye per part by weight of photoconductor. The photoconductive layer is preferably 2 to 10 μm thick, which corresponds to a layer weight of about 2 to 10 g/m$^2$, in view of the fact that the average specific weight of the layer constituents is about 1. Most preferably,the layer is 4 to 8 μm thick.

Materials such as aluminum plates, zinc plates, magnesium plates, copper plates or multimetal plates, may be used as a base layer for the photoconductive layer. Surface-finished aluminum sheets have proven particularly satisfactory. The surface finish, if employed, comprises a mechanical and/or electrochemical graining of the base layer, and optionally a subsequent anodizing and treatment with polyvinylphosphonic acid. By employing a surface finish, the length and/or volume of the print run is likely increased. The use of a surface finish on the base layer may also reduce the susceptibility to oxidation.

Preferred embodiments are specified in the following examples. pbw stands for parts by weight. $T_g$ denotes the glass transition temperature. Comparison examples are characterized by an *. The test results are summarized in tables. Table 1 shows the properties of the electrophotographic recording material according to the invention and Table 2 shows the printing properties of the printing plates produced therefrom compared with the prior art.

EXAMPLE 1

The following coating solutions were applied to an aluminum sheet grained with a pumice-powder suspension, anodized in sulfuric acid and hydrophilized with polyvinylphosphonic acid:

x pbw of a styrene/maleic anhydride copolymer (1.2:1) modified by a reaction with isobutanol/methanol, acid number 230, having a mean molar mass $M_W$ of 180,000 determined by gel permeation chromatography (GPC) using polystyrene as standard, y pbw of a styrene/acrylic acid copolymer, acid number 215, $M_W$ 4,900, $T_g$ 67° C., 5.00 pbw of 2,5-bis(4-diethylaminophenyl)-1,3,4-oxadiazole, 0.02 pbw of rhodamine FB (C.I. 45170) and 0.02 pbw of acriflavine, made up to 100.00 pbw with a mixture of butanone (=methyl ethyl ketone) and tetrahydrofuran (80:20).

The solution was dried for 2 minutes at 125° C.; the layer weight was 5.8 g/m$^2$.

Sensitometer test (see Table 1):

Charging: charging was carried out with a corona of 5.1 kV. The voltage was then measured immediately by means of a Monroe probe.

Dark discharge: The charge decrease was determined as a percentage of the initial value (i.e. of the charging) within one minute.

Photo-sensitivity: The energy needed at a radiation intensity of 22 μW/cm$^2$ (white light) for a voltage decrease to ⅛ (12.5%) of the initial value was used.

Test on a camera for processing electrophotographic printing plates (EA 693 supplied by Hoechst AG):

The ready-to-use planographic plates were charged in the dark with a corona to −550 V and exposed by projection using 8 halogen lamps of 500 watts each for 15 seconds with vertical illumination under a positive paper master (IFRA test master). The latent charge image produced was coated with toner with the aid of a magnetic brush using a toner/carrier mixture (toner based on a styrene/butyl acrylate copolymer containing charge control agent based on fatty acid and dyed with soot, mean particle diameter approximately 10 μm, carrier based on iron with a mean particle size of approximately 100 μm, mixing ratio 2:98) at a counter-voltage of 150 V. After the thermal fixing of the black toner at 130° C., the imaged plates were de-coated in a de-coating apparatus (EG 659 supplied by Hoechst AG) at a processing speed of 1.5 m/min (equivalent to an action time of approximately 15 seconds) and 26° C. using the following solution:

10% by weight ethanolamine

10% by weight of polyethylene glycol monophenyl ether

2% by weight of dipotassium hydrogenphosphate

78% by weight of fully demineralized water

Assessment criteria for the printing forms after processing in the camera (see Table 2):

Reproduction: Highlight-dot fields of a 34 dots/cm screen of the IFRA test master reproduced on the plate;

Test field 1: 8% area coverage

Test field 2: 16% area coverage

Test field 3: 27% area coverage

Overdevelopment resistance: Visual assessment of the alteration in the screen after additionally passing through the de-coating apparatus twice;

Print run: Achieved in a sheet offset press (Heidelberg GTO) using fountain water having an isopropanol content of 20%, the toner being removed from the plates before printing using a commercial washing-out agent with a hydrocarbon base (AL 21 supplied by Hoechst AG).

After processing 14 $m^2$ of planographic plates with an image proportion of 25% using 1 liter of de-coater (equivalent to approximately 70 $ml/m^2$) under the above-mentioned conditions, the contamination of the rollers and brushes of the de-coating apparatus was assessed visually and the de-coating behavior was tested for residual-layer haze. A commercial deletion fluid (KP 273 supplied by Hoechst AG) was used for correction. The above data also relates to the following examples and is not repeated therein.

EXAMPLE 2

The following coating solution was applied to an aluminum sheet electrochemically grained in nitric acid, anodized in sulfuric acid and hydrophilized with polyvinylphosphonic acid:

x pbw of a styrene/maleic anhydride copolymer (1.4:1) modified by reaction with methanol/sec-butanol, acid number 210, $M_W$ 105,000 according to GPC, y pbw of a styrene/acrylic acid copolymer, acid number 215, $M_W$ 8,500, $T_g$ 85° C., 3.20 pbw of 4-(2-chlorophenyl)-5-(4-diethylaminophenyl)-2-vinyl-1,3-oxazole, 0.80 pbw of 2,5-bis(4-diethylaminophenyl)-1,3,4-oxadiazole, 0.02 pbw of rhodamine FB (C.I. 45170) and 0.05 pbw of astrazone orange R (C.I. 48040) made up to 100.00 pbw with a mixture of butanone and propylene glycol monomethyl ether (65:55).

Testing was carried out in accordance with Example 1, but the corona voltage was 5.2 kV.

The test on a camera was carried out as in Example 1, but with the following deviation: exposure 12 seconds in transmitted light under a whole-page positive film master, de-coating at a processing rate of 1.4 m/min and 27° C. using the following solution:

10.0% by weight of ethanolamine 8.0% by weight of polyethylene glycol monophenyl ether 1.2% by weight of trisodium phosphate 80.8% by weight of fully demineralized water Assessment was carried out analogously to Example 1. However, printing was carried out in a Roland-Favorit sheet offset machine using a fountain water having an isopropanol content of 5% and an addition of damping solution of 2% (RC 621 supplied by Hoechst AG), the toner being removed from the plates before printing using a commercial washing-out agent having a fatty acid/methylester base (AL 22 supplied by Hoechst AG).

EXAMPLE 3

The following coating solution was applied to an aluminum sheet electrochemically grained in hydrochloric acid, anodized in sulfuric acid and hydrophilized with polyvinylphosphonic acid:

x pbw of a styrene/maleic anhydride copolymer (1.4:1) modified by reaction with isobutanol/methanol, acid number 210, $M_W$ 65,000 according to GPC, y pbw of a styrene/acrylic acid copolymer, acid number 240, $M_W$ 15,500, $T_g$ 102° C., 3.20 pbw of 4-(2-chlorophenyl)-5-(4-diethylaminophenyl)-2-phenyl-1,3-oxazole, 0.80 pbw of 2,5-bis(4-diethylaminophenyl)-1,3,4-oxadiazole, 0.02 pbw of rhodamine FB (C.I. 45170) and 0.05 pbw of astrazone orange G (C.I. 48035) made up to 100.00 pbw with a mixture composed of butanone and acetone (5065:5055).

The solution was dried for 2 minutes at 125° C.; the layer weight was 5.8 $g/m^2$.

Testing was carried out in accordance with Example 1, but the corona voltage was 5.2 kV and the energy needed at a radiation intensity of 22 $\mu W/cm^2$ (white light) for a charge decrease to ¼ (25%) of the initial value was used.

The testing on a camera (EA 695 supplied by Hoechst AG) was carried out as in Example 1, but with the following deviations:

Exposure: 8 seconds with vertical illumination and 8 seconds with transmitted illumination under a combined positive paper/film montage.

Development: The latent charge image produced was coated with toner with the aid of a magnetic brush using a toner/carrier mixture (toner based on a styrene/butyl acrylate/ethyl acrylate copolymer dyed with soot, mean particle diameter approximately 10 μm, carrier based on iron having a mean particle size of approximately 100 μm, mixing ratio 2:98) and fixed at 130° C.

De-coating: De-coating was carried out in a de-coating apparatus (EG 697 supplied by Hoechst AG) at a processing rate of 3.4 m/min (equivalent to an action time of 12 seconds) and 26° C. using the solution specified in Example 2.

The assessment of the reproduction, resistance to overdevelopment and the print run was carried out in accordance with Example 1, the toner not being removed before printing.

EXAMPLE 4

The following coating solution was applied to an aluminum foil electrochemically grained in hydrochloric acid, anodized in sulfuric acid, and initially hydrophilized in phosphonomethylated polyethylenimine and then with polyvinylphosphonic acid:

x pbw of a styrene/maleic anhydride copolymer (1.4:1) modified by reaction with isobutanol/methanol, acid number 210, $M_W$ 105,000 according to GPC, y pbw of a vinyltoluene/methyl methacrylate/methacrylic acid copolymer, acid number 215, vinyltoluene content 35%, $M_W$ 22,000, $T_g$ 124° C., 3.20 pbw of 4-(2-chlorophenyl)-5-(4-diethylaminophenyl)-2-phenyl-1,3-oxazole, 0.80 pbw of 2.5-bis(4-diethylaminophenyl)-1,3,4-oxadiazole, 0.02 pbw of rhodamine FB (C.I. 45170) and 0.05 pbw of astrazone orange G (C.I 48035) made up to 100.00 pbw with a mixture composed of butanone and propylene glycol monomethyl ether (65:55).

The solution was dried for 2 minutes at 125° C.; the layer weight was 5.8 g/m$^2$.

Testing was carried out in accordance with Example 1; however, the corona voltage was 5.15 kV.

The testing on a camera was also carried out in accordance with Example 1, but with the following deviations:

Exposure: as in Example 3

De-coating: as in Example 1, but with a solution composed of 10.0% by weight of ethanolamine 8.0% by weight of polyethylene glycol monophenyl ether 1.2% by weight of trisodium phosphate 80.8% by weight of fully demineralized water The assessment of the reproduction, de-coating resistance and the print run was carried out as in Example 1, the toner not being removed before printing.

The following tables show the advantages of the recording material according to the invention. The printing plates in accordance with the comparison examples characterized by –1* always showed haze formation. It was not possible therefore to de-coat them cleanly with the small amount of de-coater used. In addition, the rollers and brushes of the development apparatus were heavily contaminated after developing these printing plates. Although the comparison examples –3* did not show any such contamination, they permitted only a relatively short print run. The printing plates produced with the recording material according to the invention (denoted by –2 in the tables) manage with a small amount of de-coater and have all the advantages of the prior art.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

TABLE 1

| Examples | 1-1* | 1-2 | 1-3* | 2-1* | 2-2 | 2-3* | 3-1* | 3-2 | 3-3* | 4-1* | 4-2 | 4-3* |
|---|---|---|---|---|---|---|---|---|---|---|---|---|
| x (pbw) | 5.0 | 3.5 | 0 | 6.0 | 4.0 | 0 | 6.0 | 4.8 | 1.5 | 6.0 | 4.0 | 1.0 |
| y (pbw) | 0 | 1.5 | 5.0 | 0 | 2.0 | 6.0 | 0 | 1.2 | 4.5 | 0 | 2.0 | 5.0 |
| Charging in volts | –490 | –490 | –460 | –500 | –500 | –470 | –500 | –500 | –460 | –510 | –495 | –460 |
| Dark discharge in % | 16 | 16 | 23 | 10 | 11 | 16 | 10 | 9 | 14 | 11 | 11 | 15 |
| Photosensitivity in μJ/cm$^2$ | 170 | 170 | 150 | 170 | 170 | 150 | 90 | 88 | 83 | 175 | 170 | 155 |

TABLE 2

| Example | 1-1* | 1-2 | 1-3* | 2-1* | 2-2 | 2-3* |
|---|---|---|---|---|---|---|
| x (pbw) | 5.0 | 3.5 | 0 | 6.0 | 4.5 | 0 |
| y (pbw) | 0 | 1.5 | 5.0 | 0 | 2.0 | 6.0 |
| Reproduction from test field | 1 | 1 | 2 | 1 | 1 | 2 |
| De-coaster resistance from test field | 2 partial | 2 partial | 3 | 2 partial | 2 partial | 3 |
| Print run | 100,000 | 100,000 | 40,000 | 180,000 | 170,000 | 60,000 |
| Contamination | heavy | slight | slight | heavy | slight | slight |
| De-coating behavior | slight haze | haze-free | haze-free | slight haze | haze-free | haze-free |

| Example | 3-1* | 3-2 | 3-3* | 4-1* | 4-2 | 4-3* |
|---|---|---|---|---|---|---|
| x (pbw) | 6.0 | 4.8 | 1.5 | 6.0 | 4.0 | 1.0 |
| y (pbw) | 0 | 1.2 | 4.5 | 0 | 2.0 | 5.0 |

TABLE 2-continued

| | | | | | | |
|---|---|---|---|---|---|---|
| Reproduction from test field | 1 | 1 | 2 | 1 | 1 | 2 |
| De-coater resistance from test field | 2 partial | 2 partial | 3 | 2 partially stripped | 2 very pin-sharp | 3 |
| Print run | 170,000 | 170,000 | 60,000 | 170,000 | 160,000 | 90,000 |
| Contamination | heavy | slight | slight | heavy | slight | slight |
| De-coating behavior | slight haze | haze-free | haze-free | slight haze | haze-free | haze-free |

What is claimed is:

1. An electrophotographic recording material comprising:

an electrically conductive base layer;

a photoconductive layer which can be de-coated with alkaline solutions, said photoconductive layer comprising an organic photoconductor, a sensitizer and a binder comprising a mixture of:

a) a copolymer containing units composed of a first vinyl aromatic compound and units composed of a maleic partial ester, and b) a copolymer containing units composed of a second vinyl aromatic compound and units of (meth)acrylic acid, wherein said second vinyl aromatic compound may be the same or different from said first vinyl aromatic compound;

and wherein the weight ratio of copolymer (a) to copolymer (b) is 20:1 to 1:2.

2. A recording material as claimed in claim 1, wherein the copolymer (a) has a molar mass $M_W$ ranging from 20,000 to 300,000.

3. A recording material as claimed in claim 1, wherein the copolymer (b) has a molar mass $M_W$ ranging from 1000 to 50,000.

4. A recording material as claimed in claim 1, wherein the copolymer (b) further comprises units composed of (meth) acrylates.

5. A recording material as claimed in claim 4, wherein the copolymer (b) has a glass transition temperature of at least 50° C.

6. A recording material as claimed in claim 1, wherein at least one of the vinyl aromatic compound is a mononuclear vinyl aromatic compound.

7. A recording material as claimed in claim 1, wherein the acid numbers of the copolymers (a) and (b) are in the range from 100 to 300.

8. A recording material as claimed in claim 1, wherein the organic photoconductor comprises at least one of an oxadiazole or an oxazole, said oxadiazole or said oxazole being substituted with at least one aromatic radical and containing basic amino groups.

9. A recording material as claimed in claim 1, wherein said copolymer (a) is at least partially esterified with at least one ($C_1$–$C_6$) alkanol.

10. A recording material as claimed in claim 1, wherein the content of vinyl aromatics in the copolymer (a) and the copolymer (b) is at least 30 mol %.

11. A recording material as claimed in claim 1, wherein the organic photoconductor comprises both an oxazole and an oxadiazole, both of said oxazole and said oxadiazole being substituted with at least one aromatic radical and contain basic amino groups.

12. A recording material as claimed in claim 1, wherein the sensitizer is selected from the group consisting of triarylmethane dyes, xanthene dyes, thiazine dyes, acridine dyes, quinoline dyes, quinone dyes, ketone dyes, cyanine dyes, and mixtures thereof.

13. A recording material as claimed in claim 12, wherein the sensitizer comprises a cyanine dye.

14. A recording material as claimed in claim 13, wherein said cyanine dye is astrazone orange R or astrazone orange G.

15. A recording material as claimed in claim 1, wherein the sensitizer is present in the weight ratio of 0.001 to 0.1 parts by weight of said sensitizer per part by weight of said photoconductor.

16. A recording material as claimed in claim 1, wherein the photoconductive layer is 2 to 10 μm thick.

17. A recording material as claimed in claim 1, wherein the layer base is a metal sheet suitable for planographic printing.

18. A recording material as claimed in claim 1, wherein said recording material is a planographic printing plate.

19. A method for processing a recording material as claimed in claim 1, said method comprising:

imaging said recording material;

de-coating said recording material with a de-coating composition which is applied in an amount less than 100 $ml/m^2$.

* * * * *